US005123215A

United States Patent [19]

Acheson

[11] Patent Number: 5,123,215

[45] Date of Patent: Jun. 23, 1992

[54] GLASS BEVELING MACHINE

[75] Inventor: Donald J. Acheson, Indianapolis, Ind.

[73] Assignee: Federal Bevel, Inc., Indianapolis, Ind.

[21] Appl. No.: 683,676

[22] Filed: Apr. 15, 1991

Related U.S. Application Data

[63] Continuation-in-part of Ser. No. 479,962, Feb. 14, 1990, abandoned.

[51] Int. Cl.[5] ..... B24B 41/00

[52] U.S. Cl. ..... 51/168; 51/267

[58] Field of Search ..... 51/168, 267, 240 GB, 51/283 E, 109 R; 269/48.1, 48.2, 48.3, 48.4; 411/271

[56] References Cited

U.S. PATENT DOCUMENTS 793,402 6/1905 Storsberg ..... 411/271 X 1,703,206 3/1929 Alwill ..... 51/168

3,345,281 10/1967 Falls ..... 51/267 X 4,053,288 10/1977 Barron, Sr. ..... 51/240 GB X 4,322,915 4/1982 Kindig ..... 51/283 X

*Primary Examiner*—M. Rachuba

*Attorney, Agent, or Firm*—Woodard, Emhardt, Naughton, Moriarty & McNett

[57] ABSTRACT

A glass beveling machine. An electric motor is connected to a spindle rotatably mounted to a table. An arbor is threadedly and removably mounted to a spindle and carries a beveling head secured thereto. The bottom of a beveling head provides a grinding surface and is spaced above the table to allow a sheet of glass to be extended therebetween to facilitate grinding a beveled surface in the sheet. Liquid lubricant is circulated up through the spindle and out onto the work piece.

16 Claims, 4 Drawing Sheets

GLASS BEVELING MACHINE

CROSS REFERENCE TO RELATED APPLICATION

This application is a continuation-in-part of my copending allowed U.S. patent Application Ser. No. 479,962 filed Feb. 14, 1990 now abandoned.

BACKGROUND OF THE INVENTION

1. Field of the Invention

This invention is in the field of grinding machines, and more specifically, those used to grind a beveled surface in a sheet of glass.

2. Description of the Prior Art

Glass beveling at the hands of a master shapes and transforms a transparent substance into an extraordinary achievement. In years past, polished cuts could only de done by a master who understood his material and caressed its beauty with careful hands. Today's masters of the art of beveling glass are few, while the commercial demands for this product continue to expand. To retain the essence of this craft, and to allow greater numbers of workers to become skilled in beveling glass, the glass beveling machine disclosed herein was developed. The glass beveling machine is equally versatile as a high volume production unit or to make those occasional shapes for custom order and repairs. The machine fills the unique position of combining the irregular shape capability and variation of finish of traditional wheels with the accuracy and skill free effort of straight line bevelers.

The glass beveling machine disclosed herein allows the operator to quickly move the sheet to be beveled horizontally across a table and against a downwardly facing grinding surface. The operator therefore does not have to force the sheet being beveled downwardly against a grinding wheel as is the case in the beveling device disclosed in U.S. Pat. No. 4,322,915 issued to Kindig. It is known to provide a downwardly facing grinding surface such as shown in U.S. Pat. No. 4,053,288 issued to Barron; however, the prior art structures do not provide for ease and reliability of use. Another glass beveling machine by Barron is shown in U.S. Pat. No. 4,060,938. In many cases, the prior art structures do not allow the operator to see the surface being ground nor do they allow the operator to extend the sheet to be ground against the grinding wheel from any position surrounding the bevel wheel axis of rotation. Likewise, the means for directing lubricant against the surface being ground impedes or restricts the motion of the sheet to be ground against the grinding wheel. The liquid lubricant in the machine disclosed herein is direct upwardly through the drive shaft and then outwardly against the sheet being beveled. Directing a liquid through a shaft is known such as shown in the U.S. Pat. No. 3,609,931 issued to Voorhies. In view of the many limitations of the prior machines, I have designed and disclose herein a beveling machine having a downwardly facing grinding surface which allows the operator to direct the sheet being ground against the wheel at any position surrounding the wheel axis of rotation. In addition, the machine distributes lubricant against the surface being ground regardless of the location of the sheet relative to the wheel as the sheet is moved inwardly against the wheel.

In order to maintain accurate and repeated sizing of the beveled surface, it is necessary to accurately locate the grinding surface with respect to the table top. In many cases, this spacing or gap must be changed depending on the sizing of the thickness of the sheet. The drive train of the machine disclosed herein provides reliable adjustment means which is easily utilized to mount the grinding wheel on a rotatable drive shaft facilitating the accurate control of the gap. A number of prior patents have been granted to allow various items to be secured to a shaft. For example, see U.S. Pat. Nos. 1,719,689 issued to Buehler 3,042,094 issued to Liljeberg, 3,464,164 issued to Blohn, and 2,526,208 issued to Dowick.

SUMMARY OF THE INVENTION

One embodiment of the present invention is a bevel tool including a table with an upper surface. An electric motor with a rotatable shaft extending upwardly from the motor toward the upper surface is provided with the shaft being immovable in a direction along its longitudinal axis. A grinding head having a cavity with the axis extending therethrough is removably mounted to the shaft and has a grinding surface positioned above and facing downwardly toward the upper surface forming a gap into which a sheet of material to be ground may be moved. An adjustment device is operable to move the head in a vertical direction along the axis while the motor remains stationary to space the grinding surface a predetermined distance apart from the upper surface to grind a beveled surface into a sheet of material extended between the upper surface and the grinding head. A liquid pump having an outlet within the grinding head is operable to direct liquid through the gap to lubricate the grinding surface as the head rotates and grinds the sheet of material. A stop including a curved wall is fixedly mounted to the table beneath the head. The curved wall is immovable and has a stationary stop surface contactable by the sheet of material as the sheet is moved beneath the head. The stop further includes an upper wall above the curved wall with the upper wall extending into the cavity of the head with the shaft extending adjacent the upper wall and including a hollow center in fluid communication with the liquid pump which is operable to direct lubricant upwardly through the center into the cavity and downwardly adjacent the upper wall and then through the gap.

It is an object of the present invention to provide a new and improved glass beveling machine.

A further object of the present invention is to provide a beveling machine which will accurately control the angle and size of the beveled surface created.

In addition, it is an object of the present invention to provide a beveling machine which is relatively easy to use.

In addition, it is an object of the present invention to provide a glass beveling machine allowing for high productivity while occupying a minimum space.

Related objects and advantages of the present invention will be apparent from the following description.

DESCRIPTION OF THE PREFERRED EMBODIMENTS

Figure 1:
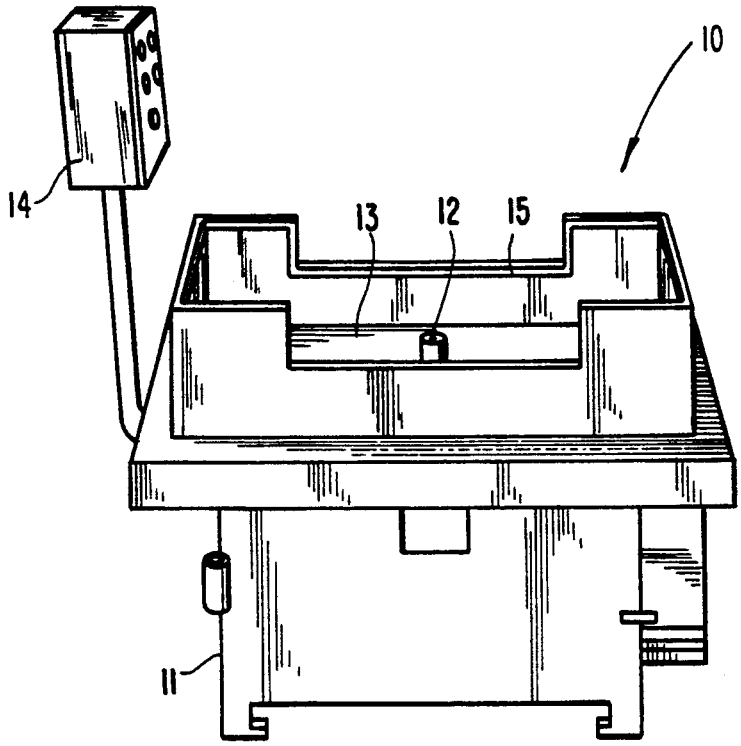
FIG. 1 is a perspective view of the glass beveling machine.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a beveling machine 10 incorporating my new invention. The machine consists of a cabinet 11 housing the means for rotating and controlling a grinding head 12 rotatably mounted above a operating table 13. An instrument panel 14 is provided for controlling and monitoring the status of the grinding head 12 and liquid lubricant applied to the grinding surface. An upright wall 15 surrounds the perimeter of the table 13 retaining the liquid lubricant on the table which is recirculated to the grinding head.

Figure 2:
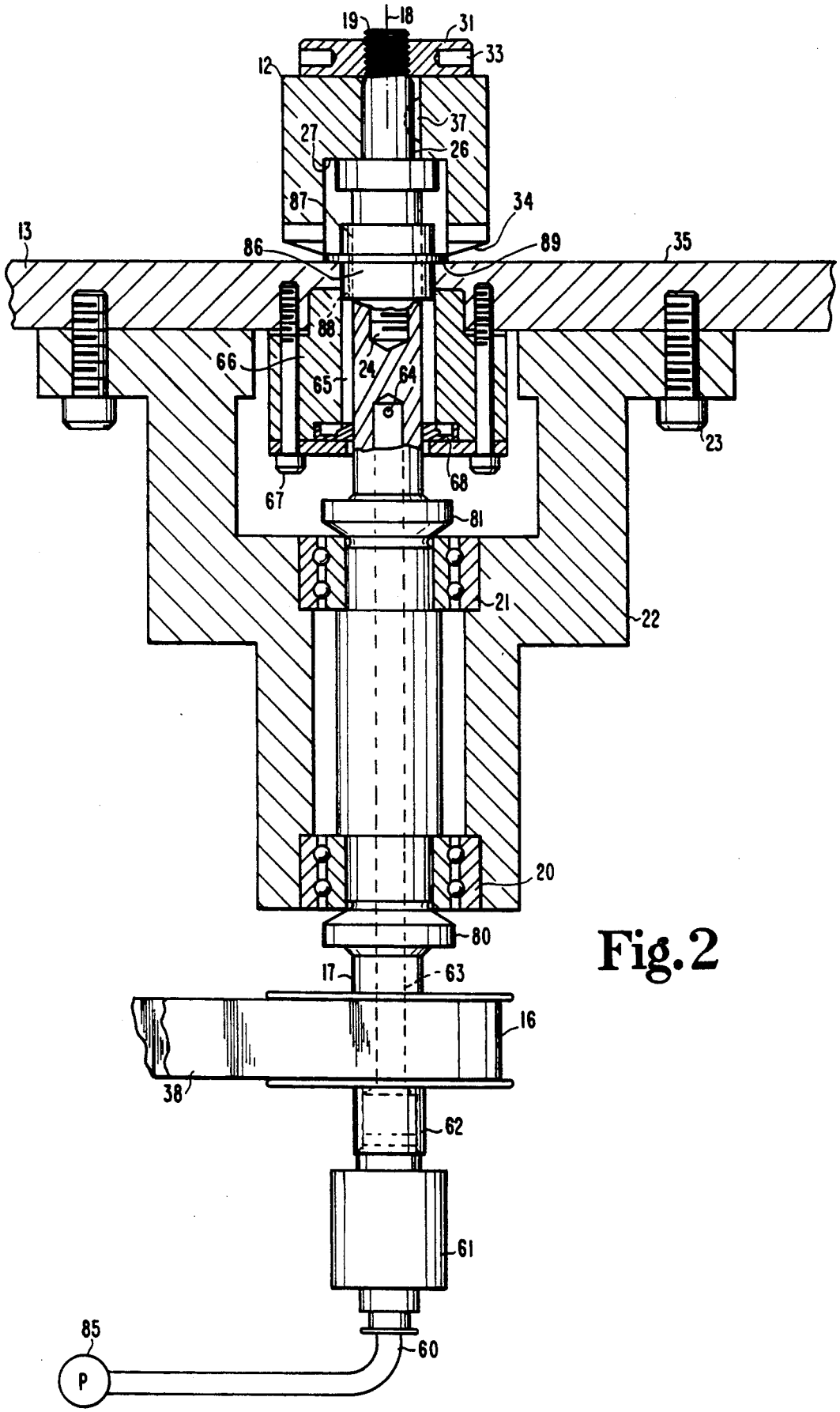
FIG. 2 is a fragmentary, vertical cross-section of the grinding head and alternate embodiment of the associated drive train.

A vertical cross-section of the head and alternate embodiment of the associated drive train is shown in FIG. 2. An electric motor is connected by belt 38 to a pulley wheet 16 fixedly secured to spindle 17. The motor is operable to rotate pulley 16 and spindle 17 about longitudinal axis 18 which extends centrally through the spindle and arbor 19 removably mounted to the spindle and positioning the grinding head 12 above table 13. Spindle 16 is rotatably mounted by conventional bearings 20 and 21 to a spindle housing 22 in turn fixedly fastened by conventional fasteners 23 to the bottom of table 13. A pair of lock nuts 80 and 81 are secured to the spindle on the opposite sides of bearings 20 and 21, thereby preventing longitudinal motion of the spindle relative to the housing. The top end of spindle 17 is provided with an internally threaded vertically opening hole 24 into which the externally threaded bottom end of arbor 19 is mounted.

Grinding head 12 has a cylindrical configuration with hole 26 extending therethrough. The hole is enlarged approximately midway along its internal length forming a ledge 27. Arbor 19 (FIG. 3) has a cylindrical ring 28 integrally formed thereon with the ring having an upwardly facing surface contacting the downwardly facing ledge 27 of head 12. The top end 30 of arbor 19 is externally threaded and projects through the top end of head 12 into an internally threaded wheel lock nut 31. Thus, once arbor 19 is threadedly mounted to spindle 17 thereby positioning ring 28 and head 12 the desired distance above table 13, lock nut 31 is threadedly mounted on to the externally threaded top end of the arbor thereby holding the head against surface 29 of the arbor ring 28 and preventing relative longitudinal or rotational motion between head and arbor 19. A conventional woodruff key 37 is provided in head 12 and arbor 19 to prevent relative rotational motion between the head and arbor. A plurality of radially extending holes 33 are provided on lock nut 31 to facilitate the tightening or loosening of the lock nut relative to the arbor.

The bottom edge portion of head 12 is beveled forming a grinding surface 34 for use in roughing, smoothing, and pre-polishing a sheet of material which is extended between surface 34 and the upwardly facing supporting surface 35 of table 13. Surface 34 is impregnated with diamond and synthetic materials, and is oriented relative to surface 35 and longitudinal axis 18 the desired angle corresponding to the beveled surface to be created in the sheet of material extended between the head and table. A variety of different sizes of grinding heads with corresponding grinding surfaces 34 are therefore provided to achieve the desired result. Grinding surface 34 extends upwardly from supporting surface 35 at an acute angle. In one embodiment, surface 34 is at a 15° angle relative to the supporting surface 35.

Figure 3:
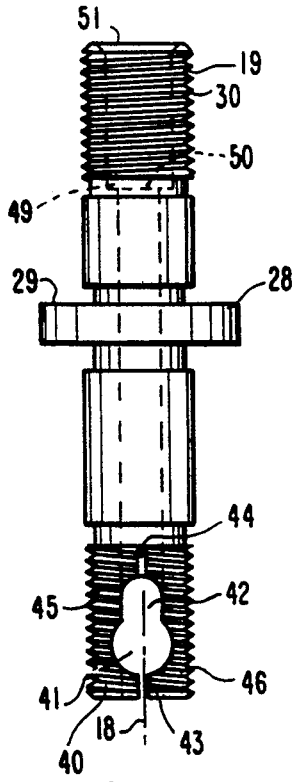
FIG. 3 is a side view of the arbor for mounting the grinding head.
Figure 4:
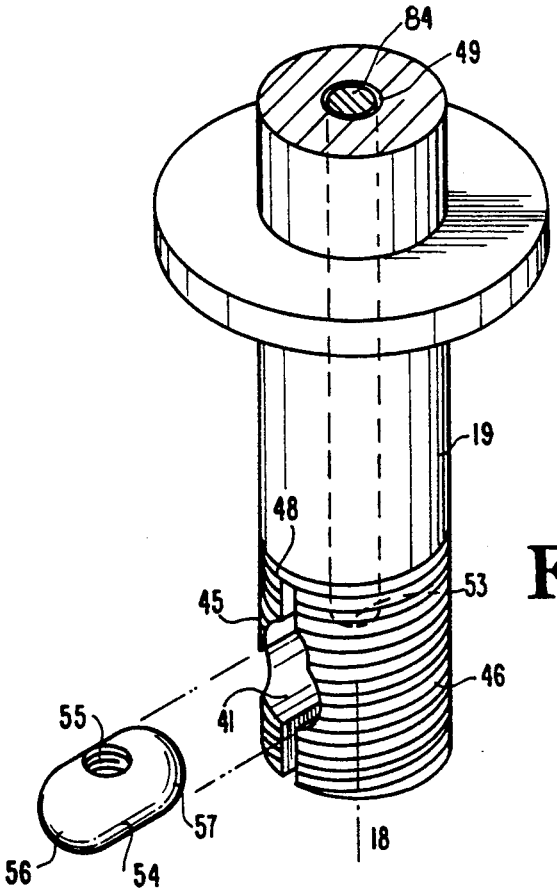
FIG. 4 is an enlarged fragmentary, perspective veiw of the bottom end of the arbor illustrating the means for securing the arbor to the spindle.

The bottom end 40 (FIG. 3) of arbor 19 is externally threaded to be removably mounted into the internally threaded top end of spindle 17. An elongated hole 41 extends through the arbor at an angle perpendicular to axis 18. Approximately 270° of hole 41 as viewed in FIG. 3 is circular with the upper portion of the hole being slotted forming a slotted hole 42 also extending through bottom end 40. A slot 43 is cut through the distal tip portion of bottom end 40 opening into hole 41 and thereby forming two spaced apart wings or arms 45 and 46 integrally joined at their top ends to the main body of the arbor. A further slot 44 extends through the arbor from hole 42 upwardly providing for relief of stress. An enlarged perspective bottom view of arbor 19 is shown in FIG. 4 illustrating the spaced apart wings 45 and 46 integrally joined at their top ends 48 to the main body of the arbor. Hole 49 extends centrally through arbor 19 into hole 41. Likewise, hole 49 extends upwardly through the top end of the arbor and is enlarged at location 49 forming an internally located ledge 50.

An externally threaded bolt 84 extends through hole 49 with the head of the bolt resting upon internal ledge 50. The bottom end 53 of the bolt 84 is in meshing engagement with nut 54 located within hole 41. Nut 54 has an internally threaded hole 55 receiving the externally threaded bottom end 53 of the bolt. Nut 54 has a cylindrical cross-section thereby fitting within hole 41 with the opposite ends 56 and 57 of the bolt being spaced apart a distance less than the outside diameter of arbor 19. By rotating bolt 84, nut 54 is pulled upwardly along axis 18 thereby contacting the upper surface of hole 41 and forcing wings 45 and 46 outwardly against the internally threaded surface defining hole 24 of the spindle preventing relative longitudinal or rotational relative motion between the arbor and spindle. Likewise, rotation of bolt 84 in the opposite direction allows nut 54 to move downwardly thereby relaxing the arbor wings relative to the spindle and facilitating loosening of the arbor relative to the spindle.

Liquid lubricant is ejected upwardly through the spindle exiting between the table and grinding head. A conventional liquid pump 85 forces the lubricant from a supply via a nylon hose 60 (FIG. 2) to a coolant coupling 61 in turn connected to the bottom end 62 of spindle 17. A number of commercially available coolant couplings are available for coupling the source of liquid to the spindle. For example, one such lubricant coupling is manufactured by Deublin Company, 1919 Stanley Street, Northbrook, Ill. 60065, under Part No. 11-035-036. Such a coupling is operable at high speeds of approximately 9,000 revolutions per minute (rpm) to connect the source of liquid to the spindle.

The spindle includes a passage 63 extending therethrough along the longitudinal axis 18 allowing the liquid lubricant to flow upwardly and exiting the spindle via hole 64. The liquid then flows into passage 65 extending between the top end of the spindle and a ring-shaped housing 66 fixedly secured to table 13 by means of conventional fasteners 67. The spindle is rotatably received in housing 66 and is sealed thereto by conventional O-ring seals 68.

Pump 85 is operable to force the liquid lubricant up through the center of spindle 17 and into passage 65. The top of passage 65 is closed by means of a cylindrical fence 86 (FIG. 2) which is press fitted to table 13. The top 87 of fence 86 extends into the hollow interior of head 12 and is provided with a hollow center through which arbor 19 freely extends. The arbor is spaced inwardly from the fence forming a ring-shaped cavity 88 allowing the liquid within passage 65 to flow upwardly through passage 88 and into the hollow interior of the grinding head. The liquid lubricant then flows out of end 87 and downwardly around the outside diameter of the fence exiting between the table 13 and head 12 thereby wetting the sheet of glass being ground as well as grinding surface 34. The center portion 89 of the fence is enlarged providing a outwardly facing projection or stop surface against which the object to be ground will contact, thereby limiting further inward movement of the object being ground. The bottom edge of the head is spaced slightly above enlarged portion 89 to facilitate outward flow of the liquid lubricant. Various drains are provided around the periphery of the table to collect the liquid lubricant recirculating the same back to pump 85 which in turn redirects the liquid lubricant upwardly through the spindle.

In order to operate the grinding machine, the electrical motor is activated causing pulley wheel 16 and spindle 17 to rotate thereby rotating the grinding head. Simultaneously, the liquid lubricant is circulated by pump 85 exiting in the gap formed between the bottom beveled surface 34 and the upwardly facing supporting surface of table 13. A sheet of material such as glass is then moved inwardly towards the head atop table 13 thereby entering the gap between grinding surface 34 and the upwardly facing surface of the table causing the head to grind a beveled surface onto the sheet of material. A variety of controls may be provided to control the operation of the glass beveling machine. For example, the electric motor may be turned on by a main power "ON" switch and an indicator provided to indicate rotation of the grinding head. Likewise, a pump "ON/OFF" switch is provided to allow the liquid lubricant to continuously run during operation. An indicator may be provided to show whether the flow of lubricant is below a certain level. A brake switch may also be provided to lock the spindle in place facilitating the removal of lock nut 31 and head 12. A brake light may be provided to indicate whether the brake has been activated. A variety of means may be used to lock the spindle in place including a motor control to lock the output and thereby lock the spindle. A variety of different types of motors may be used. Best results have been obtained by utilizing a constant torque output motor thereby allowing multiple operators to simultaneously bevel sheets with the same beveling head applying additional load on the spindle. Supplemental light may be provided by a quartz light with suitable "ON/OFF" controls located on the control panel. A speed control may also be provided to control the rotational speed of the spindle.

The gap existing between the beveling head and the top of the table will depend on the thickness of the sheet extended therebetween as well as the amount of wear occurring on the grinding surface. Once the desired gap distance has been determined, the arbor with head is threaded downwardly onto the spindle with lock nut 31 tightened. Once the arbor has been threaded on the spindle a sufficient amount to create the desired gap, threaded member 84 may be tightened locking the arbor to the spindle.

Figure 5:
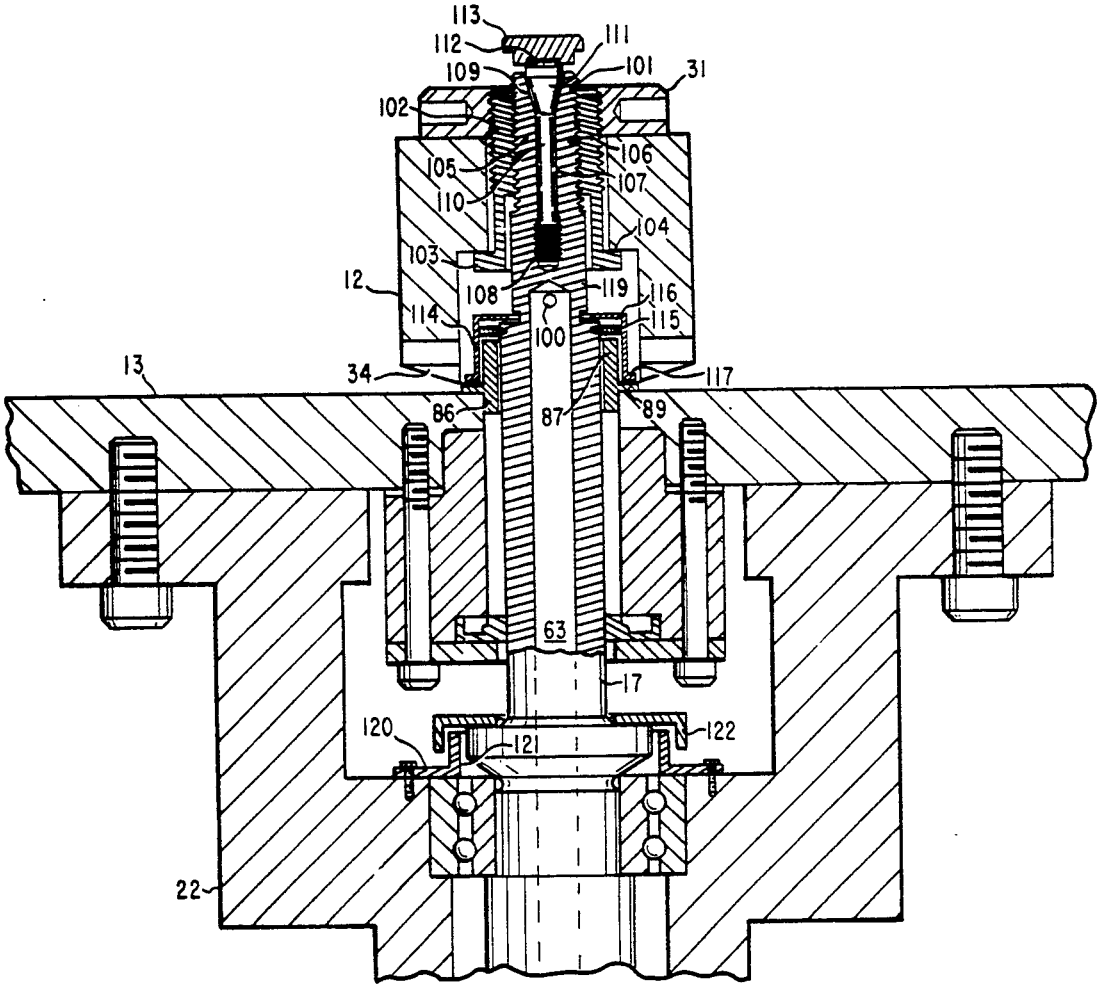
FIG. 5 is a fragmentary, vertical cross section of the grinding head and preferred embodiment of the associated drive train.

FIG. 5 shows a fragmentary, vertical cross section of the grinding head and preferred embodiment of the associated drive train as compared to the alternate embodiment of the drive train shown in FIGS. 2 through 4. That portion of the drive train which extends beneath a table 13 of the two embodiments is identical with the exception that in FIG. 5 the lubricant passage 63 extends through the entire length of spindle 17 opening within grinding head 12 via outlet 100. As a result, outlet 64 (FIG. 2) is not provided in the preferred embodiment of FIG. 5 and thus the lubricant does not exit the spindle and flow upwardly through a passage existing between the spindle and cylindrical fence 86. The structure for securing the grinding head to the spindle and for adjustment of the gap between the grinding head and table top is different for the embodiment shown in FIG. 5 as compared to FIGS. 2 through 4. As a result, threaded hole 24 (FIG. 2) is not provided in the spindle shown in FIG. 5.

Spindle 17 (FIG. 5) extends upwardly through fence 86 which is identical to the fence previously described for the embodiment of FIGS. 2 through 4. The top end 101 of spindle 17 is cylindrical and includes external threads in meshing engagement with the hollow threads surrounding the hollow interior of cylindrical arbor 102. A ring 103 is integrally provided at the bottom end of arbor 102 and extends outwardly forming a ledge 104 upon which cylindrical grinding wheel 12 is supported. An internally threaded wheel nut 31 rests atop grinding wheel 12 and is in meshing engagement with the external threads provided on the top end of arbor 102. Thus, wheel nut 31 may be rotated downwardly along the axis of the spindle thereby forcing grinding wheel 12 against ledge 104 and securing the grinding wheel and arbor together. The grinding wheel and arbor may then be rotated about the longitudinal axis of the spindle thereby advancing the arbor and wheel upwardly or downwardly along the length of the top end of the spindle so as to control the gap existing between the downwardly facing grinding surface 34 of the grinding head and the upwardly facing surface of table 13.

The top end 101 of the spindle is split into a plurality of expandable portions. For example, in the vertical cross section shown in FIG. 5, the top end includes opposite portions 105 and 106 which are separated by a downwardly extending hole 107. The bottom end 108 of hole 107 is internally threaded whereas the top end 109 is flared outwardly. An expander bolt 110 is threadedly received in the hole and includes a cone shaped top end 111 moveable against flared end 109 to move opposite portions 105 and 106 against the internal threads of arbor 102 locking the arbor to the spindle. An arbor wrench 113 includes a downwardly facing cavity complimentary in shape to receive the upwardly extending projection 112 of the expander bolt 110. For example, projection 112 may take the form of a triangle complimentary in shape to a triangular shaped cavity of arbor wrench 113. The arbor wrench may be used to tighten or loosen the expander bolt thereby to tighten or loosen the spindle to the arbor and head.

A skirt 114 surrounds the upwardly extending cylindrical top end 87 of fence 86. The skirt is secured to spindle 17 by means of a plurality of set screws 115. The spindle has a reduced diametered cylindrical portion 119 located above fence 86 and is further reduced in diameter at the threaded top end 101. The top end 116 of skirt 114 extends inwardly above the main body of the spindle but includes a cylindrical hole extending through top end 116 to allow the skirt to be moved upwardly past cylindrical portion 119 in the event the skirt is to be disassembled from the spindle. The bottom end 117 of the skirt extends outwardly immediately above the ring shaped center portion 89 of the fence. The lubricant outlet 100 is located in portion 119 of the spindle immediately above the top end 116 of the skirt. The fence is operable to direct the lubricant exiting outlet 100 outwardly across the top end 116 of the skirt and then downwardly between the fence and the grinding head exiting in the gap between the grinding head and the table top. The skirt limits flow of lubricant and foreign material in a reverse direction toward the spindle thereby limiting maintenance problems with the rotating spindle. Fence 86 is also operable to prevent the spindle from wobbling during rotation. The outside diameter of the spindle is ground to within 0.0002 inches of the inside diameter of fence 86. As a result, fence 86 is advantageous in that it prevents foreign material from entering between the spindle and fence. Likewise, a ring shaped seal 120 is fixedly mounted to housing 22 and includes an upwardly extending wall 121 surrounding nut 81. A flinger ring seal 122 is sealingly mounted atop nut 81 and projects inwardly of wall 121 thereby limiting flow of liquid toward bearing 21.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A tool for forming an upwardly facing ground surface in a sheet of material comprising:

a frame with an upwardly facing supporting surface to support said sheet of material during grinding;

a vertically immovable source of rotary power located beneath said supporting surface and mounted to said frame and including a rotatable output located beneath said supporting surface and extending upwardly along a vertical axis of rotation from said source to said supporting surface;

a grinding head mounted to said output and rotatable therewith, said head having a hollow interior and being spaced apart from said supporting surface forming a gap with said head including a grinding surface facing downwardly toward said supporting surface to contact and grind atop said sheet of material forming said upwardly facing ground surface as said sheet is extended into said gap;

connecting means removably connecting said head to said output;

locking means operable to adjustably and lockingly control the size of said gap facilitating receipt of a different thickness of said sheet of material, said locking means preventing longitudinal motion of said grinding head both upwardly and downwardly along said axis with said output being longitudinal immovable;

stop means between said head and supporting surface operable to limit inward travel of said sheet of material therebetween;

liquid lubrication means operable to emit liquid wetting said ground surface, said liquid lubrication means having a fence mounted to said upwardly facing surface and surrounding said vertical axis of rotation, said fence extending upwardly above said upwardly facing surface into said hollow interior of said grinding head but being spaced inwardly therefrom forming a first liquid passage within said head and between said head and said fence with said first liquid passage exiting at said gap to direct liquid onto said grinding surface, said lubrication means further includes a source of pressurized liquid operable to force liquid through said fence and into said hollow interior of said head and then radially outward from said fence through said liquid passage onto said grinding surface; and circulation means operable to receive said liquid wetting said ground surface and recirculate said liquid to said lubrication means; and wherein:

said fence includes a cylindrical wall and a cylindrical surrounding flange, said cylindrical wall is mounted to said supporting surface with said flange positioned atop said supporting surface and fixedly mounted to said frame beneath said head, said flange forming said stop means between said head and said supporting surface operable to limit travel of said sheet, said flange is immovable and has a curved stationary stop surface contactable by said sheet as said sheet is moved into said gap.

2. The tool of claim 1 wherein said rotatable output is a hollow shaft connected together with said locking means forming a second liquid passage within said fence leading to said first liquid passage, said hollow shaft in liquid communication with said second liquid passage with said lubrication means operable to force liquid through said second liquid passage, over said fence, into said first liquid passage and then through said gap onto said grinding surface.

3. The tool of claim 1 wherein:

said head and said locking means are mounted as a unit to said rotatable output to size said gap, said locking means includes an arbor with an expandable bottom end, said rotatable output includes a hollow top end in meshing engagement with said expandable bottom end of said arbor, said arbor extending centrally through said head and into said rotatable output, said locking means further includes threaded means extending centrally through said head and into said expandable bottom end being operable to allow said head with grinding surface to be moved relative to said upwardly facing supporting surface sizing said gap and then operable upon rotation of said threaded means to expand said expandable bottom end against said hollow top end locking said arbor with said head to said rotatable output.

4. A glass beveling machine comprising:

a frame with a supporting surface to support a sheet of glass to be beveled;

a source of rotary power including an output having a longitudinal axis extending through said supporting surface with said output being rotatable on said axis but fixed and non-adjustable in position along the length of said axis relative to said supporting surface;

a grinding head mounted to said output and rotatable therewith, said head being spaced apart from said supporting surface forming a gap with said head including a grinding surface facing downwardly toward said supporting surface to contact and grind said sheet forming a beveled surface as said sheet is extended into said gap;

stop means between said head and said supporting surface operable to limit travel of said sheet, said stop means includes a stop wall fixedly mounted to said frame beneath said head, said stop wall is immovable and has a curved stationary stop surface contactable by said sheet as said sheet is moved into said gap, said stop means including a liquid passage extending therethrough exiting within said grinding head;

lubrication means including a source of pressurized liquid operable to force liquid upwardly through said liquid passage into said grinding head and then exiting said head through said gap wetting said sheet of glass; and, first means connecting said head to said output and operable to adjustably control the size of said gap facilitating receipt of a different thickness of said sheet.

5. The glass beveling machine of claim 4 wherein:

said stop means located between said head and said supporting surface is within said gap, said stop means includes a continuous wall surrounding said liquid passage with said continuous wall spaced inwardly from said head directing liquid from said liquid passage to flow between said continuous wall and said head and then exit said head via said gap.

6. The glass beveling machine of claim 5 wherein:

said frame includes a table with an upper surface forming said supporting surface and further includes an upright wall surrounding and extending above said upper surface; and further comprising:

pump means having an inlet on said table to receive liquid flowing off of said head and having a pump for recirculating said liquid to said stop means.

7. A bevel tool comprising:

a table with an upper surface;

electric motor means with a rotatable shaft beneath said upper surface extending upwardly from said motor means toward said upper surface, said shaft being immovable in a direction along its longitudinal axis;

a grinding head with said axis extending therethrough being removably mounted to said shaft and having a grinding surface positioned above and facing downwardly toward said upper surface forming a gap into which a sheet of material to be ground may be moved;

adjustment means operable to move said head in a vertical direction along said axis while said motor means remains stationary to space said grinding surface a predetermined distance apart from said upper surface to grind a beveled surface into a sheet of material extended between said upper surface and said grinding head;

liquid pump means having an outlet adjacent said upper surface and within said grinding head operable to direct liquid through said gap to lubricate said grinding surface as said head rotates and grinds said sheet of material; and, stop means including a curved wall fixedly mounted to said table beneath said head, said curved wall is immovable and has a stationary stop surface contactable by said sheet of material as said sheet is moved beneath said head, said stop means further includes a continuous wall connected to said curved wall with said continuous wall extending into said head, said shaft connected to said grinding head and spaced apart from said continuous wall forming a passage, said shaft includes a hollow center in fluid communication with said liquid pump means operable to direct lubricant upwardly through said passage, in between said continuous well and said grinding head and then through said gap.

8. The bevel tool of claim 7 wherein:

said adjustment means includes an arbor connected to said shaft, said arbor includes a ledge upon which said head rests and is supported above said table, said arbor extends into said continuous wall forming said passage therebetween, said adjustment means includes fastening means connecting said arbor to said shaft and allowing said ledge and said head to be adjustably locked at locations along said axis to control sizing of said gap.

9. A bevel tool comprising:

a table with an upper surface;

electric motor means with a rotatable shaft extending upwardly from said motor means toward said upper surface, said shaft being immovable in a direction along its longitudinal axis;

a grinding head having a cavity with said axis extending therethrough being removably mounted to said shaft and having a grinding surface positioned above and facing downwardly toward said upper surface forming a gap into which a sheet of material to be ground may be moved;

adjustment means operable to move said head in a vertical direction along said axis while said motor means remains stationary to space said grinding surface a predetermined distance apart from said upper surface to grind a beveled surface into a sheet of material extended between said upper surface and said grinding head;

liquid pump means having an outlet within said grinding head operable to direct liquid through said gap to lubricate said grinding surface as said head rotates and grinds said sheet of material;

stop means including a curved wall fixedly mounted to said table beneath said head, said curved wall is immovable and has a stationary stop surface contactable by said sheet of material as said sheet is moved beneath said head, said stop means further includes an upper wall above said curved wall with said upper wall extending into said cavity of said head, said shaft extending adjacent said upper wall and including a hollow center in fluid communication with said liquid pump means which is operable to direct lubricant upwardly through said center into said cavity and downwardly adjacent said upper wall and then through said gap; and, lubrication distribution and sealing means mounted to said shaft and extending downwardly toward said gap from a location between said outlet and above said upper wall, said lubrication distribution and sealing means both operable to distribute said lubricant downwardly around said axis and to limit reverse flow of said lubricant and foreign material toward and between said shaft and said upper wall.

10. The bevel tool of claim 9 wherein:

said adjustment means includes an arbor mounted to said shaft, said arbor includes an internally threaded passage, an external threaded cylindrical outer surface and an outwardly extending ledge beneath said threaded cylindrical outer surface atop of which said head is supported, said shaft includes a threaded top end extending through said threaded passage, said adjustment means further includes a fastening device with an internal threaded hole in meshing engagement with said external threaded cylindrical outer surface securing said head to said arbor and locking said head atop said ledge, said arbor is adjustable along said axis to move said ledge with said head and said fastening device to and from said table to size said gap.

11. The bevel tool of claim 10 wherein:

said top end of said shaft is split into a plurality of expandable portions, said adjustment means includes an expander bolt extendable into said top end to expand said portions into said arbor securing said arbor to said shaft.

12. The bevel tool of claim 9 wherein:

said lubrication distribution and sealing means includes a skirt mounted to said shaft and surrounding said upper wall of said stop means with said skirt extending from beneath said outlet to above said curved wall limiting flow of material from external of said skirt toward said shaft.

13. A glass beveling machine comprising:

a frame with a supporting surface to support a sheet of glass to be beveled;

a source of rotary power including a hollow output shaft with an outlet and having a longitudinal axis extending through said supporting surface with said shaft being rotatable on said axis but fixed and non-adjustable in position along the length of said axis relative to said supporting surface;

a grinding head mounted to said shaft and rotatable therewith, said head being spaced apart from said supporting surface forming a gap with said head including a grinding surface facing downwardly toward said supporting surface to contact and grind said sheet forming a beveled surface as said sheet is extended into said gap;

stop means between said head and said supporting surface operable to limit travel of said sheet, said stop means includes a stop wall fixedly mounted to said frame beneath said head, said stop wall is immovable and has a curved stationary stop surface contactable by said sheet as said sheet is moved into said gap, said stop means including a passage extending therethrough with said shaft extending through said passage into said grinding head;

lubrication means including a source of pressurized liquid operable to force liquid upwardly through said hollow output shaft into said grinding head and then exiting said head through said gap wetting said sheet of glass;

lubrication distribution and sealing means mounted to said shaft and extending downwardly toward said gap from a location between said outlet and above said stop wall, said lubrication distribution and sealing means both operable to distribute said lubricant downwardly around said axis and to limit reverse flow of said lubricant and foreign material toward and between said shaft and said stop wall; and, first means connecting said head to said shaft and operable to adjustably control the size of said gap facilitating receipt of a different thickness of said sheet.

14. The glass beveling machine of claim 13 wherein:

said stop means includes an upwardly extending wall surrounding said shaft and extending from said frame to said outlet; and, said lubrication distribution and sealing means includes a skirt mounted to said shaft and surrounding said upwardly extending wall limiting flow of liquid from external of said skirt to said shaft.

15. The glass beveling machine of claim 14 wherein:

said first means includes an arbor threadedly mounted directly to said shaft, said arbor has an outwardly extending ledge upon which said grinding head is supported and includes an upper externally threaded portion, said first means includes a internally threaded fasterner threadedly mounted directly to said portion securing said head onto said ledge and allowing said arbor, head and fastener to be adjusted along said shaft, said shaft has a split top end forming expandable portions, said first means further includes an expander fastener extendable into said top end to expand said portions against said arbor securing said arbor to said shaft.

16. The glass beveling machine of claim 15 wherein:

said outlet is in fluid communication with said source of pressurized liquid and positioned within said grinding head and above said skirt with said liquid exiting said outlet flowing outwardly atop said skirt and downwardly through said grinding head exiting same via said gap.

* * * * *

UNITED STATES PATENT AND TRADEMARK OFFICE

CERTIFICATE OF CORRECTION

PATENT NO. : 5,123,215

DATED : June 23, 1992

INVENTOR(S) : Donald J. Acheson

It is certified that error appears in the above-indentified patent and that said Letters Patent is hereby corrected as shown below:

Column 1, line 54, change the word "direct" to read "directed".

Column 3, line 35, change the word "wheet" to read "wheel".

Column 7, lines 21 and 23, change the word "fence" to read "skirt".

Column 10, line 21, change the word "well" to read "wall".

Signed and Sealed this

Twentieth Day of July, 1993

*Attest:*

Michael K. Kirk

MICHAEL K. KIRK

*Attesting Officer*

*Acting Commissioner of Patents and Trademarks*